US005393287A

United States Patent [19]

Papapaschalis

[11] Patent Number: 5,393,287

[45] Date of Patent: Feb. 28, 1995

[54] EXERCISE DEVICE

[76] Inventor: Dimitrios Papapaschalis, 48 Montgomery St., Saugerties, N.Y. 12477

[21] Appl. No.: 132,187

[22] Filed: Oct. 6, 1993

[51] Int. Cl.[6] ..... A63B 26/00

[52] U.S. Cl. ..... 482/142; 601/52; 601/128; 601/131; 601/24; 5/115

[58] Field of Search ..... 482/142, 54; 601/49, 601/52, 115, 128, 131, 23, 24, 122; 5/933, 448, 652; 108/115

[56] References Cited

U.S. PATENT DOCUMENTS 767,221 8/1904 Hagen ..... 482/54

4,757,987 7/1988 Allemand ..... 482/54

*Primary Examiner*—Richard J. Apley
*Assistant Examiner*—Lynne A. Reichard
*Attorney, Agent, or Firm*—John Maier, III

[57] ABSTRACT

An exercise device which includes a series of rolling spindles upon which the person using the device rests their body, the spindles being a series of crest and valleys to create rollers which rub against the body of the user when exercising. The device includes a central section and two end sections which can be folded down at right angles to the central section to form a table with inserts to fill in the corner spaces. In the alternative, the end sections may be folded under the central section so as to make a compact device for ready storage.

5 Claims, 3 Drawing Sheets

EXERCISE DEVICE

BACKGROUND OF THE INVENTION

The present invention relates to exercise devices and more particularly to an exercise device which massages the user while exercising thereon and which may also be converted into a decorative piece of furniture and also be compactly stored.

It is increasingly common for people to exercise in their homes. Frequently exercise devices are large and very costly and are difficult to store and basically are unsightly.

In exercising on a mat or on the floor, persons doing such exercises have found that their muscles frequently become tight after exercising. It is not uncommon for people after a great deal of exercise to be massaged but such services are expensive and such services are frequently not available.

The instant invention overcomes many of these problems by creating a device with body massaging roller spindles upon which a person can exercise properly and conveniently and as such person moves upon the roller spindles in the course of the exercising, the person's body is massaged. The device may be readily folded into a table and may also be reduced to a compact package for storage.

SUMMARY OF THE INVENTION

In accordance with the present invention, there is provided an exercise device with roller spindles upon which the a person using the device places their body. As such person moves their body during exercise, the rolling spindles massage the body of the user. The device may be readily folded into a table or completely folded into a compact package for storage.

The exercise device includes a pair of side rails with a series of roller spindles, mounted between the side rails. Cross rails are located at each end and support dowels extend between the side rails to give support. The side rails each have three sections, namely a central section and two end sections. The end sections are shorter than the central section but the central section and the end sections are aligned with one another.

The roller spindles are mounted between the two side rails in the central section and in both of the two end sections. The rotatable spindles are round and include a series of rounded crests and valleys, formed from generally spherical units located side by side. The roller spindles, have at their ends, a standard shaft of constant cross section. The two ends of each roller spindle are rotatably mounted in opposite side rails. When the roller spindles are mounted between the side rails, they are placed in such a manner that a valley and a crest alternate from adjacent roller spindle to adjacent roller spindle.

Holes are provided along the top surface of the side rails to permit the installation of removable and interchangable handles and foot supports so that a person resting on the roller spindles may hold onto handles or press their feet against foot supports as may be desired by the particular exercise being done, while their body rests upon and moves on the roller spindles and is massaged by the crests in the roller spindles.

The novel features, which are considered as characteristic of the invention, are set forth with particularity in the appended claims. The invention itself, however, as to its construction and obvious advantages, will be best understood from the following description and the specific embodiment when read with the accompanying drawings.

DRAWINGS

DESCRIPTION OF THE PREFERRED EMBODIMENT

Figure 1:
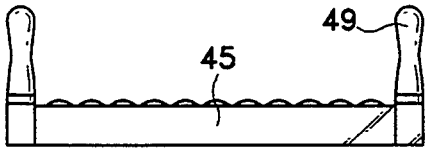
FIG. 1 is an end view of the exercise device showing the handles in place and the roller spindles extending slightly above the cross rail.
Figure 2:
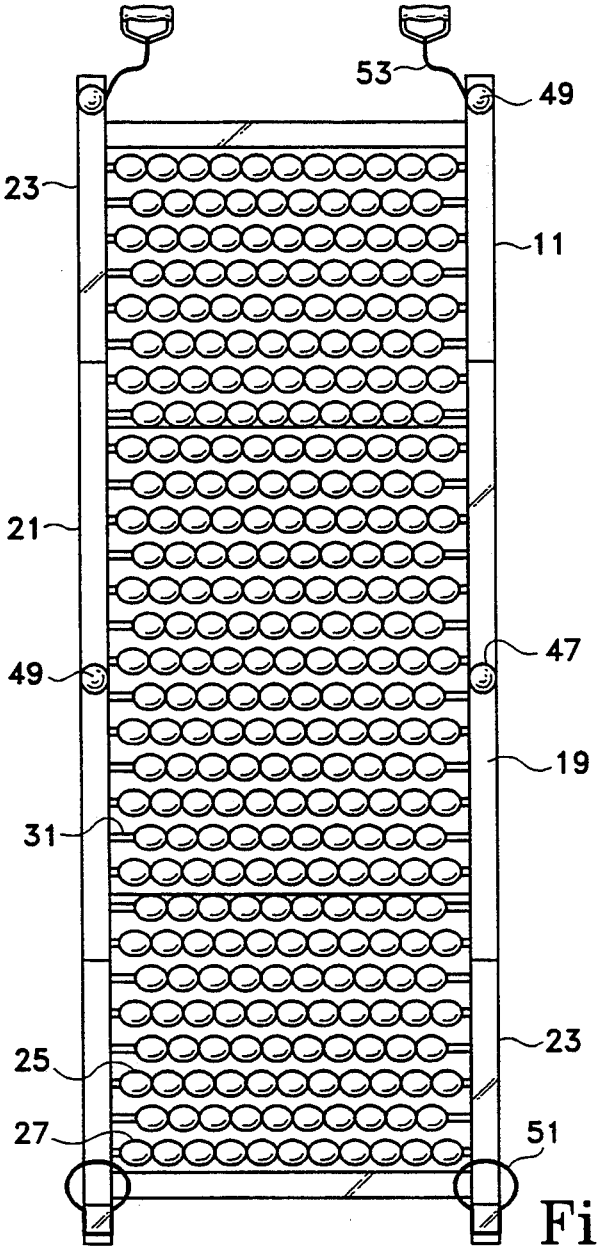
FIG. 2 is a plan view of the exercise device showing handles and foot supports in place and with thongs tied to the handles at one end.
Figure 4:
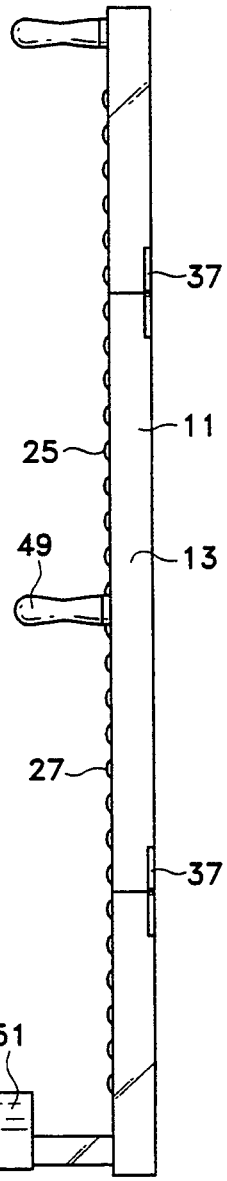
FIG. 4 is a side elevation of the exercise device showing the central section and two end sections with two pairs of handles in place and one pair of foot supports in place.
Figure 3:
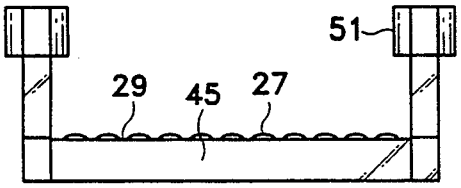
FIG. 3 is an end view of the exercise device at the end opposite from that shown in FIG. 1 and showing the foot supports in place.
Figure 5:
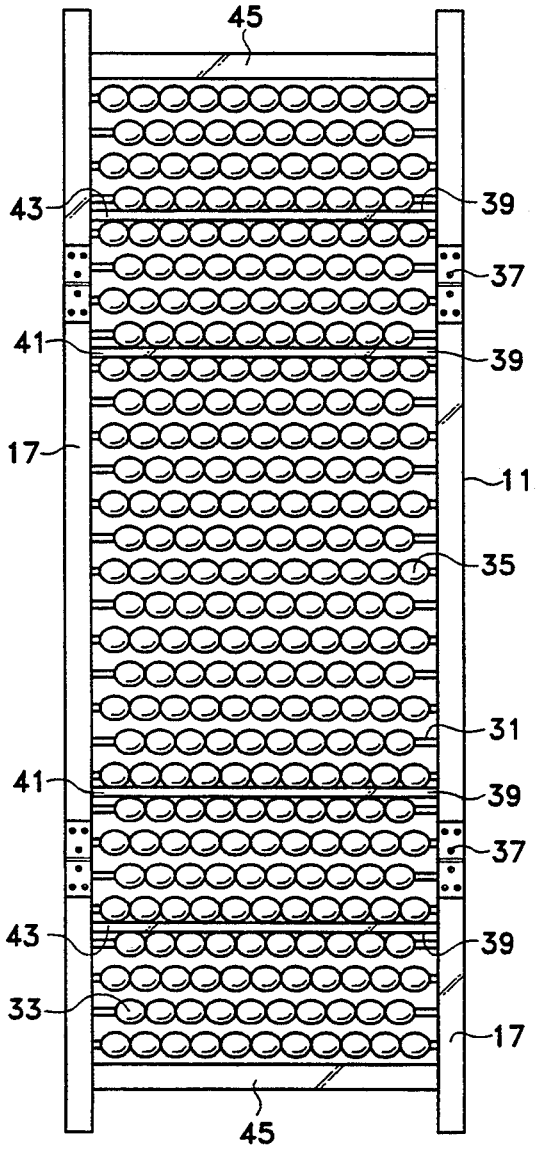
FIG. 5 is a plan view of the underside of the exercise device showing the hinges and the support dowels.
Figure 6:
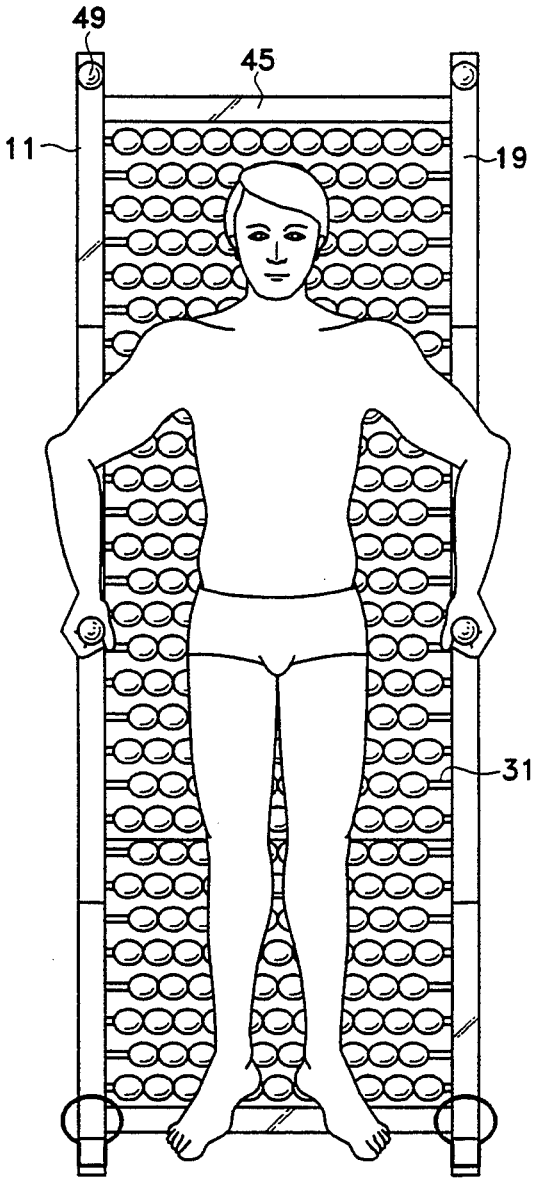
FIG. 6 is a view similar to FIG. 2 but with a person on the exercise device.
Figure 7:
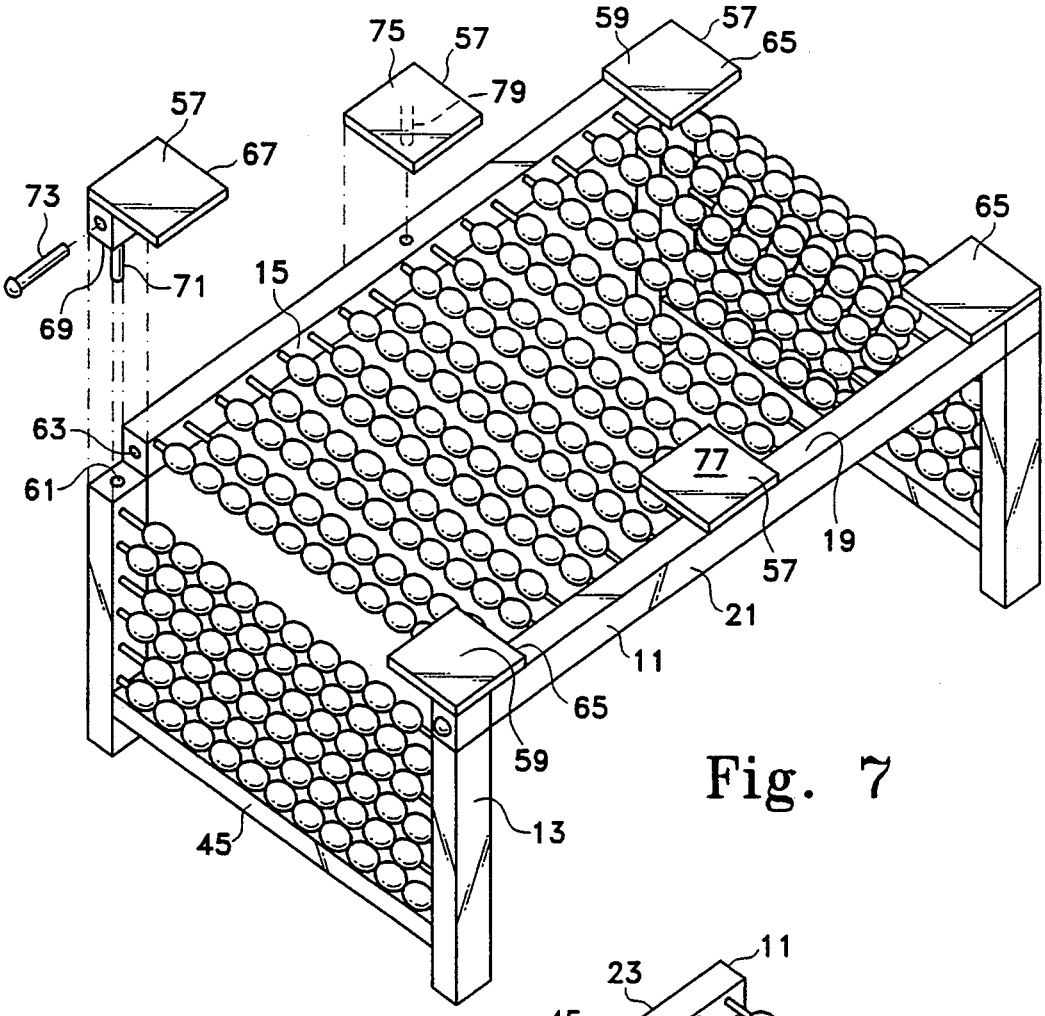
FIG. 7 is a perspective view of the exercise device with the end sections turned down ninety degrees and with some inserts in place and one with corner insert and one central insert shown in exploded form.
Figure 8:
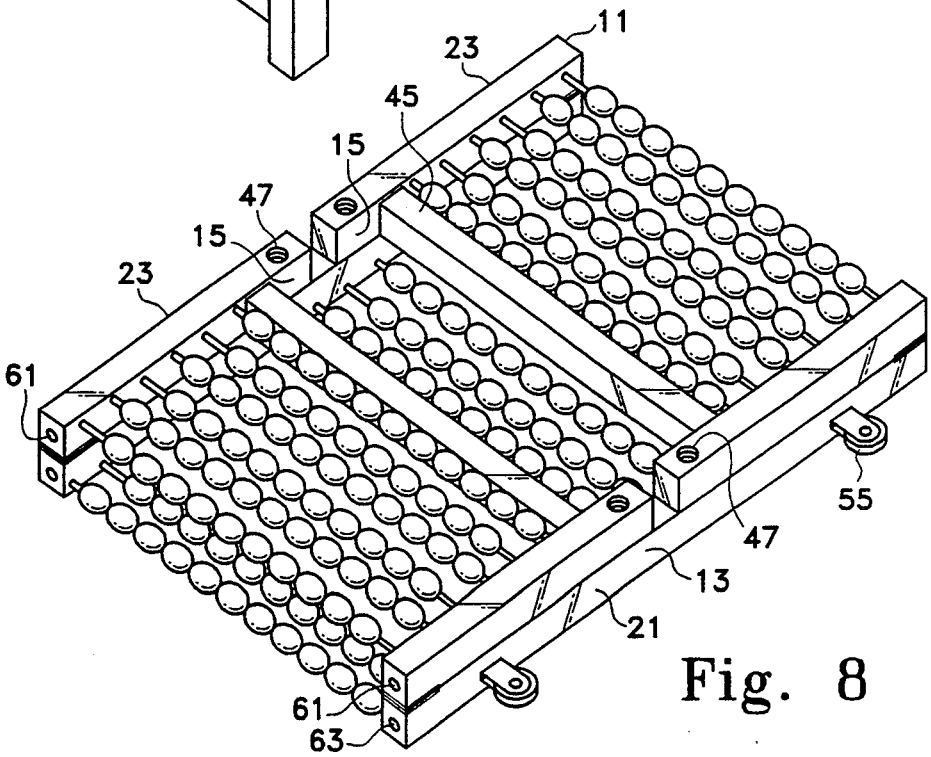
FIG. 8 is a perspective view of the exercise device completely folded and showing the casters in place.

Referring now to the drawings, an exercise device is shown, which includes a pair of side rails 11 which are parallel to one another and are in a generally equally spaced relationship to one another. The side rails 11 preferably have a rectangular cross section. Each side rail has an outside surface 13 and an inside surface 15. The two inside surfaces 15 face one another. Each side rail 11 also has an under surface 17 and a top surface 19.

The pair of side rails 11 are formed in three sections, namely a central section 21 and two end sections 23. The central section 21 is larger than the end sections 23 and the end sections 23 and the central sections 21 are all aligned with one another. The end sections 23 are each slightly shorter than one-half the length of the central section 21.

Between the side rails 11 there are located a multiplicity of roller spindles 25. The roller spindles 25 are located generally at right angles to the side rails 11 and are rotatably mounted in the side rails 11 and are generally equally spaced from one another. Each roller spindle 25 includes a series of alternating rounded crests 27 and valleys 29. Each rounded crest 27 has essentially the same size and shape as all the other rounded crests 27 on all of the roller spindles 25. Each rounded crest 27 is essentially formed as a ball or sphere, the valleys 29 being formed by the joining of the sides of adjoining spheres. The crests 27 extend slightly above the top surface 19 of the side rails 11.

Each roller spindle 25 has two shaft ends 31 which are shafts with a generally constant diameter, the diameter of the shaft ends 31 being slightly smaller than the diameter of the valleys 29.

There are two versions of the roller spindle 25, namely a reduced spindle 33 and a greater spindle 35. The greater spindle 35 has one more rounded crest 27 than the reduced spindle 33.

The greater spindles 35 and the reduced spindles 33 are alternated. As a result of this alternating of greater spindles 35 and reduced spindles 33, the rounded crests 27 of each roller spindle 25 have a valley 29 aligned therewith on the adjacent roller spindle 25. Similarly, the valleys 29 of each roller spindle 25 are aligned with rounded crests 27 on the adjacent roller spindles 25.

The two end sections 23 of the side rails 11 are affixed to the central section 21 by hinges 37 which are located on the under surface 17 of the side rails 11. The hinges 37 permit each end section 23 to be rotated to a ninety degree position to form legs, thus converting the exercise device into a table and further permitting the end sections 23 to be rotated completely around a half circle to fit snugly under the central section 21 reducing the exercise device to a very compact package for easy storage.

Support dowels 39 are provided to give added strength to the device. Two pairs of support dowels 39 are used including an inner pair 41 and an outer pair 43.

The inner pair 41 of support dowels 39 extend generally at right angles between the outside surfaces 13 of the side rails 11 and within the central section 21 but adjacent to the hinges 37.

The outer pair 43 of support dowels 39 also extend generally at right angles between the outside surfaces 13 of the side rails 11, one support dowel 39 of the outer pair 43 being located in one end section 23 and the other support dowel 39 of the outer pair 43 being located in the other end section 23. Both outer pair 43 support dowels 39 also are located adjacent to the hinges 37 but on the opposite side thereof from the inner pair 41 of support dowels 39.

A pair of cross rails 45 are fixedly mounted at opposite ends of the side rails 11, generally at right angles to the inside surfaces 15 of the side rails 11 at the end of the end sections 23 remote from the central section 21.

The cross rails 45 and the support dowels 39 provide, with the side rails 11, the structural support for the roller spindles 25.

In the top surface 19 of each side rail 11, a series of holes 47 are located. One located at each end both end section 23 remote from the central section 21 and one in the center of the central section 21. Handles 49 and foot supports 51 are removably and interchangably located in the holes 47. The handles 49 and foot supports 51 provide a place for the user to grip with their hands and for the user to press their feet respectively during exercising. Ropes or thongs 53 may also be attached to the handles 49 to provide greater flexibility to the user.

A pair of casters 55 are also mounted on the outside surface 13 of the central section 21 of one of the pair of side rails 11. When the end sections 23 are folded under the central section 21 and against the central section 21, the exercise device can readily be moved without lifting by rolling the exercise device along the floor on the casters 55.

One great advantage of the exercise device is that as an alternative to storing the exercise device when totally folded, the exercise device may be partially folded and used as a table with inserts 57 to provide a table top surface 59 which may be used for any purpose for which a table would be used.

In order to convert the exercise device into a table which is both study and appealing, openings 61 are provided in the end section 23 of each side rail 11 which openings 61 extend longitudinally into the end sections 23 at the end adjacent to the central sections 21. The central sections 21 also have openings 63 extending longitudinally into the central sections 21 at both ends of the central sections 21 of the side rails 11.

As can be readily understood, when the end sections 23 are folded down at right angles to be used as table legs, corner spaces exist between the end sections 23 and the central sections 21. It is also essential when using the exercise device as a table to lock the end sections 23 at the ninety degree position to the central sections 21. Accordingly, four corner inserts 65 are provided each including a flat rectangular member 67 with a block 69 extending at right angles from the flat rectangular member 67. One dowel 71 is fixed mounted on the block 69 at right angles to the flat rectangular member 67. Another dowel 73 is slidably mounted in the block 69 generally parallel with the flat rectangular member 67. Each slidable dowel 73 is adapted to fit into one of the openings 63 in the central section 21 and the fixed dowel is adapted to fit into one of the openings 61 in the end sections 23. Once in place, the four corner inserts 65 assure that the end sections 23 are rigidly affixed to the central sections 21 at a ninety degree position.

Two central inserts 75 are also provided. Each central insert 75 also includes a flat rectangular member 77 similar to the flat rectangular members 67 which are a part of the four corner inserts 65.

A dowel 79 extends generally at right angles from each flat rectangular member 77 of the central inserts 75. Each dowel 79 of each central insert 75 is adapted to fit into one of the holes 47 in the central section 21 of the side rails 11.

The exercise device when used as a table, can be enhanced by placing a hard plastic sheet or sheets (not shown) preferably transparent on the roller spindles 25. One sheet may be placed between the four corner inserts 65 and the central inserts 75 longitudinally on the exercise device or two sheets (not shown) may be placed between two of the four corner inserts 65 and the central inserts 75 and on both sides of the central inserts 75. Most simply, one sheet of hard plastic (not shown) can cover the entire table top resting on the four corner inserts 65 and the central inserts 75.

As to materials, a hard wood, such as maple, ash or walnut creates a fine furniture piece but plastic or aluminum or any strong, comparatively light material may be used.

The novel features, which are considered as characteristic of the invention, are set forth with particularity in the appended claims. The invention itself, however, as to its construction and obvious advantages, will be best understood from the following description and the specific embodiment when read with the accompanying drawings.

I claim:

1. An exercise device which can be folded into a compact package and used as a table, said exercise device comprising:

a pair of side rails, generally parallel to one another and in a spaced relationship, each side rail having a rectangular cross section and having an inside surface and an outside surface and further having a central section and two end sections the end sections being located on opposite ends of the central section, each end section being shorter in length than the central section;

hinges affixed_to the two end sections and to the central section at opposite ends of the central section;

means for rigidly connecting the pair of side rails to one another; each side rail having a hole therein located generally centrally in the central section of each side rail and another hole at the end of each end section of the side rails most remote from the central section; each end section of each side rail further having an opening extending longitudinally into the end section at the end thereof adjacent the central section having an opening extending longitudinally into the central section at both ends of the central section of the side rails.

a series of roller spindles mounted rotatably generally at right angles between the pair of central side rails and generally equidistant from one another, each roller spindle having a series of rounded crests and valleys adjacent to one another; each rounded crest and each valley being substantially the same in size and shape, each roller spindle having a crest opposite valleys on adjoining roller spindles; and handles and foot supports removably and interchangeably mounted in the holes in the central section and the end sections;

2. An exercise device according to claim 1 further including:

four corner inserts each including a flat rectangular member with a block extending at right angles from the rectangular member with one dowel fixedly mounted in the block and at right angles to the flat rectangular member and another dowel slidably mounted in the block generally parallel with the flat rectangular member, each slidable dowel being adapted to fit into one of the openings in the central section and the fixed dowel being adapted to fit into one of the openings in the end sections.

3. An exercise device according to claim 1 further including:

four corner inserts each including a flat rectangular member with a block extending at right angles from the rectangular member with one dowel fixedly mounted in the block and at right angles to the flat rectangular member and another dowel slidably mounted in the block generally parallel with the flat rectangular member, each slidable dowel being adapted to fit into one of the openings in the central section and the fixed dowel being adapted to fit into one of the openings in the outside section; and two central inserts; each including a flat rectangular member with a dowel fixedly extending generally at right angles from the flat rectangular member, the dowel being adapted to fit into one of the holes in the central section of the side rails.

4. An exercise device which can be folded into a compact package and used as a table, said exercise device comprising:

a pair of side rails, generally parallel to one another and in a spaced relationship, each side rail having a rectangular cross section and having an inside surface and an outside surface and further having a central section and two end sections the end sections being located on opposite ends of the central section, each end section being shorter in length than the central section;

hinges affixed to the two end sections and to the central section at opposite ends of the central section;

an inner pair of support dowels extending generally at right angles between the central section of the pair of side rails and being affixed to the inside surfaces of the central section of the side rails;

an outer pair of support dowels, one pair extending generally at a right angle between one end section of side rails and the other pair extending generally at right angles between the other end section of side rails, both the inner pair of support dowels and the outer pair of support dowels being located adjacent the hinges, each side rail having a hole therein located generally centrally in the central section of each side rail and another hole at the end of each end section of the side rails most remote from the central section, both of said holes being at right angles to the support dowels, the end section of each side rail further having an opening extending longitudinally into the end section at the end thereof adjacent the central section and the central section further having an opening extending longitudinally into the central section at both ends of the central section of the side rails;

a pair of cross rails each one fixedly mounted between separate outside section of the side rails adjacent to the end of the outside sections remote from the central section;

a series of roller spindles mounted rotatably generally at right angles between the pair of central side rails, each roller spindle having a series of rounded crests and valleys adjacent one another, each rounded crest and each valley being substantially the same in size and shape, each roller spindle having two ends, each end being a shaft of generally constant circular cross section, one shaft on one end being longer than the shaft on the opposite end, the diameter of the shafts being generally equal and being slightly smaller than the diameter of the valleys, each roller spindle having a crest opposite valleys on adjoining roller spindles; and handles and foot supports removably and interchangably mounted in the holes in the central section and the end sections;

four corner inserts each including a flat rectangular member with a block extending at right angles from the rectangular member with one dowel fixedly mounted in the block and at right angles to the flat rectangular member and another dowel slidably mounted in the block generally parallel with the flat rectangular member, each slidable dowel being adapted to fit into one of the openings in the central section and the fixed dowel being adapted to fit into one of the openings in the outside section;

two central inserts, each including a flat rectangular member with a dowel fixedly extending generally at right angles from the flat rectangular member, the dowel being adapted to fit into one of the holes in the central section of the side rails; and a pair of rollers mounted on the outside surface of the central section of one side rail.

5. An exercise device which can be folded into a compact package and used as a table, said exercise device comprising:

a pair of side rails, generally parallel to one another and in a spaced relationship, each side rail having a rectangular cross section and having an inside surface and an outside surface and further having a central section and two end sections the end sections being located on opposite ends of the central section, each end section being shorter in length than the central section;

hinges affixed to the two end sections and to the central section at opposite ends of the central section;

means for rigidly connecting the pair of side rails to one another, each side rail having a hole therein located generally centrally in the central section of each side rail and another hole at the end of each end section of the side rails most remote from the central section, said means for rigidly connecting the pair of side rails including an inner pair of support dowels extending generally at a right angle between the central section of the pair of side rails and being affixed to the inside surfaces of the central section of the side rails and an outer pair of support dowels, one pair extending generally at a right angle between one outside section of side rails and the other pair extending generally at right angles between the other outside section of side rails, both the inner pair of support dowels and the outer pair of support dowels being located adjacent the hinges and a pair of cross rails each one fixedly mounted between a separate outside section of the side rails adjacent to the end of the end sections remote from the central section.

a series of roller spindles mounted rotatably generally at right angles between the pair of central side rails, each roller spindle having a series of rounded crests and valleys adjacent one another, each rounded crest and each valley being substantially the same in size and shape, each roller spindle having two ends, each end being a shaft of generally constant circular cross section, one shaft on one end being longer than the shaft on the opposite end, the diameter of the shafts being generally equal and being slightly smaller than the diameter of the valleys, each roller spindle having a crest opposite valleys on adjoining roller spindles; and handles and foot supports removably and interchangeably mounted in the holes in the central section and the end sections.

* * * * *